US007105800B1

(12) United States Patent
Staerzl

(10) Patent No.: US 7,105,800 B1
(45) Date of Patent: Sep. 12, 2006

(54) DETECTION SYSTEM AND METHOD FOR A PROPELLER DRIVEN MARINE VESSEL WITH A FALSE TRIGGERING PREVENTION CAPABILITY

(75) Inventor: Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 357 days.

(21) Appl. No.: 10/691,955

(22) Filed: Oct. 23, 2003

(51) Int. Cl.
*B63H 1/00* (2006.01)

(52) U.S. Cl. ..... 250/221; 340/567; 340/984; 440/1

(58) Field of Classification Search ..... 250/221; 340/565, 567, 600, 984; 701/301; 440/1, 440/71

See application file for complete search history.

(56) References Cited

U.S. PATENT DOCUMENTS

| | | | | |
|---|---|---|---|---|
| 5,074,488 | A | 12/1991 | Colling | |
| 5,311,012 | A | 5/1994 | Juds et al. | |
| 5,418,359 | A | 5/1995 | Juds et al. | |
| 6,354,892 | B1 | 3/2002 | Staerzl | |
| 6,380,871 | B1 * | 4/2002 | Kaplan | 340/984 |
| 6,416,371 | B1 * | 7/2002 | Johnson | 440/71 |
| 6,450,845 | B1 | 9/2002 | Snyder et al. | |
| 6,676,460 | B1 * | 1/2004 | Motsenbocker | 440/1 |
| 6,693,561 | B1 * | 2/2004 | Kaplan | 340/984 |

OTHER PUBLICATIONS

"Propeller Guard Update", 2002-2003, (Internet Website : http://www.rbbi.com/invent/guard/propg/updates/2002/prop2002.htm).
"What if???" (Internet Website: http://www.rbbi.com/invent/guard/propg/whatif.htm).
"Disciplines Sensing Presence" (Internet Website: http://www.rbbi.com/invent/guard/propg/discip.htm).
RBBI Inventions (Internet Website: http://www.rbbi.com/invent/invrbbi.htm).

* cited by examiner

*Primary Examiner*—Stephone B. Allen
*Assistant Examiner*—Davienne Monbleau
(74) *Attorney, Agent, or Firm*—William D. Lanyi

(57) ABSTRACT

A detection system and method for a marine vessel uses an infrared sensor to detect the presence of a human being or mammal in a target area near the propulsor. A visible light detector is used to determine whether or not a signal received from the infrared sensor is caused by reflected sunlight and not the actual presence of a human being or mammal. By detecting visible light, false triggering of the system in response to infrared radiation received from sunlight can be significantly reduced. Embodiments of the system can monitor gear position and engine speed in combination with signals received from the infrared sensor and visible light sensors to determine an appropriate action to take in response to the presence of infrared radiation above a preselected threshold.

27 Claims, 6 Drawing Sheets

DETECTION SYSTEM AND METHOD FOR A PROPELLER DRIVEN MARINE VESSEL WITH A FALSE TRIGGERING PREVENTION CAPABILITY

BACKGROUND OF THE INVENTION

1. Field of the Invention

The present invention is generally related to a detection system for a propeller driven watercraft and, more particularly, to a system and method that detects the presence of human beings and other mammals above the surface of the water in the vicinity of a marine propulsion device behind the transom of a marine vessel.

2. Description of the Prior Art

Outboard motors have been used for many years to propel many different types of marine vessels. Sterndrive systems are also well known to those skilled in the art. Devices have been developed in an attempt to insulate human beings from potential harm caused by a rotating propeller of a marine vessel.

U.S. Pat. No. 5,074,488, which issued to Colling on Dec. 24, 1991, describes an aircraft engine deactivation apparatus. The apparatus is intended for stopping an aircraft engine while the aircraft is on the ground. The apparatus is for detection purposes and used to prevent a detected object from coming into contact with an engine driven propeller or a jet propulsion intake. A detector, preferably an infra-red radiation sensor, detects an object or person within a selected distance and within a selected area about the engine. Upon detection, a mechanical engine deactivator shuts down the engine. A by-pass switch renders the system inoperable, when desired.

U.S. Pat. No. 6,354,892, which issued to Staerzl on Mar. 12, 2002, discloses a detection device for a marine vessel. The detection device provides an infrared sensor with a tube having a central cavity in order to define a viewing angle which is more narrow than the inherent viewing angle of the infrared sensor. The central cavity of the tube also defines a line of sight and can be directed toward a particular region above the surface of the water near a marine vessel that is to be monitored for the presence of a heat generating object, such as a human being. An alarm circuit is responsive to signals from the infrared sensor and deactivates the marine propulsion system when a heat generating object is near the marine propulsion system. The length and diameter of the tube are selected to provide a desired viewing angle for the infrared sensor. An audible alarm output is provided if an attempt is made to manipulate a joystick that controls the marine propulsion system when a heat generating object is sensed by the infrared sensor.

U.S. Pat. No. 6,450,845, which issued to Snyder et al on Sep. 17, 2002, discloses a passive occupant sensing system for a watercraft. A tetherless occupant detector system uses an infrared sensor and a monitor circuit that provides a deactivation signal to an engine control unit and other control mechanisms in the event of an operator of the marine vessel leaving a preselected control position at its helm. The infrared sensor provides an output signal that is generally representative of the heat produced by an occupant within the controlled position of a marine vessel. The monitor circuit reacts to a sudden decrease in this heat magnitude and provides a deactivation signal in response to detecting this sudden decrease. The deactivation signal provided by the monitor circuit can be received by an engine control unit which then, in turn, deactivates a marine propulsion system.

Alternatively, the deactivation signal itself can cause a deactivation of the marine propulsion system.

U.S. Pat. No. 5,418,359, which issued to Juds et al on May 23, 1995, describes a method and apparatus for detecting objects with range-dependent blocking. A method and apparatus is disclosed which allow the detection of an object by the generation of a radiated beam and a subsequent reflection by the object of a portion thereof. The detection of particulate object material due to a reflection of a portion of the generated beam is minimized.

U.S. Pat. No. 5,311,012, which issued to Juds et al on May 10, 1994, describes a method and apparatus for detecting objects with modifying gain and sensor means. This patent is generally similar to U.S. Pat. No. 5,418,359, described above.

The patents described above are hereby expressly incorporated by reference in the description of the present invention.

The use of infrared sensors to detect the presence of human beings or animals within a prescribed detection zone is well known to those skilled in the art. This type of system is commonly used to turn on lights when a human being passes through a detection zone. Any warm blooded animal can be sensed by an infrared detector.

An inherent problem associated with infrared detectors is that normal sunlight contains electromagnetic radiation that is within the infrared portion of the spectrum. As a result, an infrared detector can be erroneously triggered by reflected sunlight received by its sensing components. In the discussion below, a triggering of an infrared detection system by reflected sunlight, and not the heat generated by a human or other warm blooded animal, will be referred to as a "false" trigger because the infrared radiation is the result of reflected sunlight and not the result of the situation which is intended to be detected (the presence of a human or other warm blooded animal). When used in certain applications, such as in conjunction with a marine propulsion system, false triggering of an infrared sensor by reflected sunlight can have very deleterious effects. As an example, sunlight reflected off the surface of a body of water can be interpreted by an infrared sensing system as being indicative of the presence of a human being or marine mammal within the detection zone of the sensing system. This could falsely cause the triggering of a sensing circuit which could turn off an engine of the marine propulsion system. On a bright, sunny day, the detection circuit could be plagued with numerous false detections of this type.

It would therefore be significantly beneficial if a detection system could be employed to protect an area surrounding a propeller of a marine vessel in such a way that humans and marine mammals could be detected, but reflected sunlight would not produce false triggering of the infrared detection system.

SUMMARY OF THE INVENTION

A detection system for a propeller driven marine vessel, made in accordance with the preferred embodiment of the present invention, comprises first and second electromagnetic radiation sensors. Each of the radiation sensors is sensitive to a preselected range of wavelengths. The electromagnetic radiation sensors are attachable to a marine vessel (e.g. its transom or propulsion device) and can be directed toward associated target areas in order to receive electromagnetic radiation from within the target area. Each of the electromagnetic radiation sensors is configured to provide a signal which is representative of the magnitude or change in magnitude of electromagnetic radiation, within their respective ranges of wavelengths, which emanates from their respective target areas.

The present invention further comprises a processor that is connected in signal communication with the electromagnetic radiation sensors and configured to receive the signal provided by those sensors. The processor is also configured to respond to a preselected change in the first or second signals by causing a change in the operation of the marine vessel.

As will be described in greater detail below, the change in the operation of the marine vessel, caused by the processor, can include a deactivation of the marine propulsion device or the activation of an audio signal, such as a horn, or both. The processor can be appropriate circuitry which comprises discreet components selected and associated together to receive the signals from the two electromagnetic radiation sensors, process those signals, and determine whether or not a human being or other mammal is within their respective target areas. Alternatively, the processor can be a microprocessor that is appropriately programmed to receive the signals from the first and second electromagnetic radiation sensors, process those signals, and select an appropriate action as a result of the changes sensed in those signals.

The precise characteristic of the two electromagnetic radiation sensors of the present invention can vary as a function of the particular application of the present invention. In certain applications, a single infrared sensor and a single visible light sensor can be used. In other applications, two infrared sensors can be used. In more complex systems, two infrared sensors can be used in combination with two visible light sensors, in a manner which will be described in greater detail below. As a result, the first preselected range of wavelengths can extend from one micrometer to one millimeter. In other words, the first preselected range of wavelengths can include the infrared portion of the electromagnetic spectrum. The first and second preselected ranges of wavelengths can be generally equal to each other. In alternative embodiments of the present invention, the second preselected range of wavelengths can extend from 400 nanometers to 700 nanometers. In other words, the second preselected range of wavelengths can include the visible portion of the electromagnetic spectrum.

The first and second electromagnetic radiation sensors are intended to be attachable to either a marine vessel or a marine propulsion device of a marine vessel to detect the presence of mammals above the surface of the water behind the marine vessel. Although the present invention will be described below in conjunction with an application wherein the sensors are attached to the rear portion of a marine vessel, it should be clearly understood that a benefit may also be achieved by attaching the sensors elsewhere on some marine vessels where the detection of the presence of mammals, such as human beings, may be desirable.

In a particularly preferred embodiment of the present invention, third and fourth electromagnetic radiation sensors can also be used. The first and third electromagnetic radiation sensors can be selected to be sensitive to infrared radiation while the second and fourth electromagnetic radiation sensors can be selected to be sensitive to visible electromagnetic radiation. The processor, in this particularly preferred embodiment, can be connected in signal communication with the first, second, third, and fourth electromagnetic radiation sensor and configured to receive first, second, third, and fourth signals from those sensors, respectively. The microprocessor can be configured to respond to a preselected change in the first or third signals by changing a particular operation of the marine vessel, such as by deactivating the engine or sounding a horn.

In a particularly preferred embodiment of the present invention, the processor is configured to refrain from changing the operation of the marine vessel if the second and fourth signals indicate a presence of visible light within the second and fourth target areas respectively. In other words, if the magnitude of visible light in the region of the marine propulsion device changes, the change is interpreted as indicating reflected sunlight that could possibly produce a false trigger by one or both infrared sensors. When this occurs, the processor refrains from acting on the detection of infrared light by the infrared sensors until the magnitude of visible light sensed by the other two electromagnetic sensors indicates that the reflection of sunlight has ceased. In this way, the occurrence of false triggering can be reduced.

The method of the present invention comprises the step of providing a first electromagnetic radiation sensor, directing the first electromagnetic radiation sensor toward a first target area, and configuring the first electromagnetic radiation sensor to provide a first signal which is representative of electromagnetic radiation within a first preselected range of wavelengths emanating from within the first target area. The present invention further comprises the step of providing a second electromagnetic radiation sensor, directing that second electromagnetic radiation sensor toward a second target area, and configuring the second electromagnetic radiation sensor to provide a second signal which is representative of electromagnetic radiation within the second preselected range of wavelengths emanating from within the second target area. The method further provides a processor which is connected in signal communication with the first and second electromagnetic radiation sensors in order to receive the first and second signals. The present invention further comprises the step of responding to a preselected change in the combined status of the first and second signals by changing an operation of the marine vessel, such as by activating a horn or deactivating an engine of the marine propulsion system. One embodiment of the present invention uses a sensor which contains a band pass filter that passes only wavelengths between 7 micrometers and 14 micrometers. This is the range of wavelengths that are typically emitted by living mammals, including human beings.

The present invention is intended for use in several different embodiments. A single infrared sensor can be used in combination with a single visible light sensor. A pair of infrared sensors can be used in conjunction with one or two visible light sensors. Depending on the application, either one or two infrared sensors can be used in a system made in accordance with a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
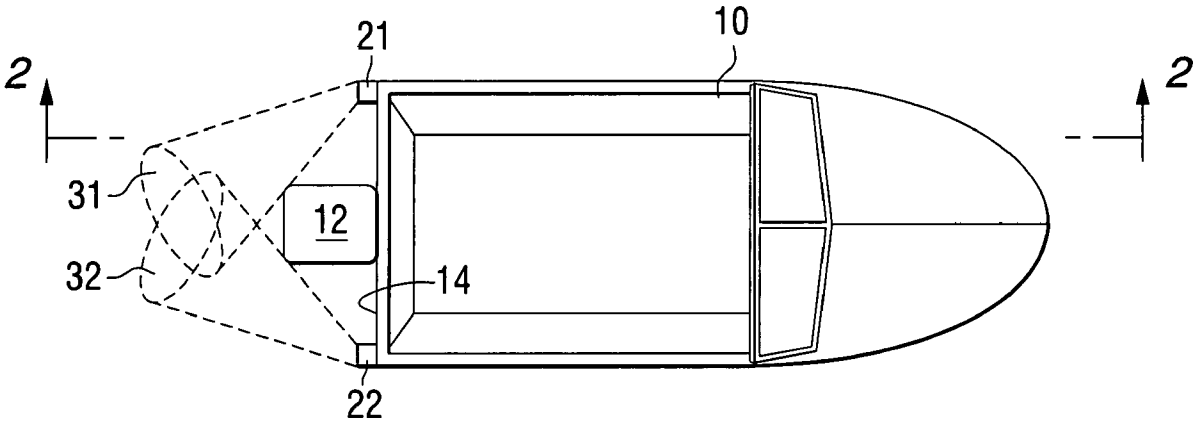
FIG. 1 is a schematic representation of a top view of a marine vessel with two sensors attached to its transom.

Throughout the description of the preferred embodiment of the present invention, like components will be identified by like reference numerals.

FIG. 1 is a schematic representation of a top view of a marine vessel 10 with a marine propulsion device 12 attached to its transom 14. A first electromagnetic radiation sensor 21 is attached to the transom 14. The first electromagnetic radiation sensor 21 is sensitive to a first preselected range of wavelengths. It is attachable, as shown in FIG. 1, to a marine vessel 10 and can be directed toward a first target area 31 to receive electromagnetic radiation from within the first target are 31. The first electromagnetic radiation sensor 21 is configured to provide a first signal which is representative of electromagnetic radiation within the first preselected range of wavelengths emanating from within the first target area 31. A second electromagnetic radiation sensor 22 is sensitive to a second preselected range of wavelengths. The second electromagnetic radiation sensor 22 is attachable, as shown in FIG. 1, to the marine vessel 10 and can be directed toward a second target area 32 to receive electromagnetic radiation from within the second target area 32. The second electromagnetic radiation sensor 22 is configured to provide a second signal which is representative of electromagnetic radiation within the second preselected range of wavelengths emanating from within the second target area 32. In the illustration of FIG. 1, the first and second target areas, 31 and 32, are arranged so that they overlap each other.

In certain embodiments of the present invention, the first and second electromagnetic radiation sensors can be selected to be sensitive to radiation from two different ranges of wavelengths. As an example, the electromagnetic radiation sensor can be selected to be sensitive to wavelengths between 1 micrometer and 1 millimeter. In other words, it can be selected to be sensitive to a range of wavelengths which include the infrared portion of the electromagnetic spectrum.

Alternatively, an infrared sensor can be combined with a visible light detector that is sensitive to wavelengths in the range of 400 nanometers to 700 nanometers. In other words, the second preselected range of wavelengths can include the visible portion of the electromagnetic spectrum.

Figure 2:
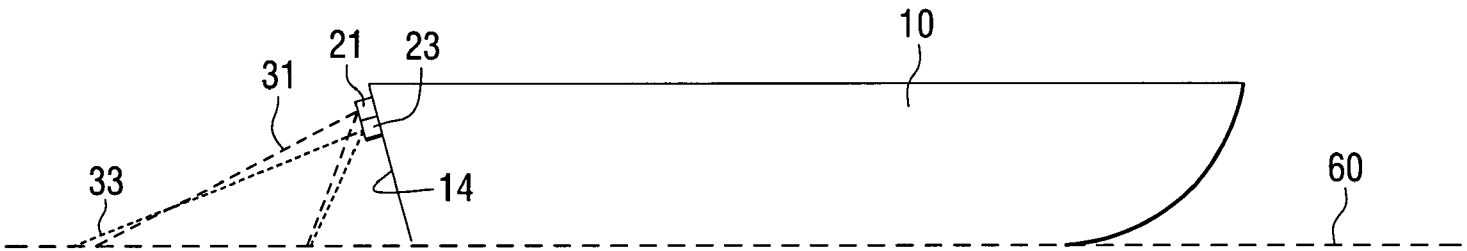
FIG. 2 is a section view of FIG. 1.

FIG. 2 shows a section view taken through FIG. 1 so that only the port side of the marine vessel 10 is illustrated. Below the first electromagnetic radiation sensor 21, a third electromagnetic radiation sensor 23 is attached to the transom 14. The target area 31 of the first electromagnetic radiation sensor 21 is illustrated behind the marine vessel and above the surface of the water. In addition, a third target area 33 associated with the third electromagnetic radiation sensor 23 is shown. If, in this preferred embodiment of the present invention, the first electromagnetic radiation sensor 21 is an infrared sensor and the third electromagnetic radiation sensor 23 is a visible light sensor, they are directed to detect both infrared and visible light within the overlapping area between the first and second target areas, 31 and 33. The combined use of an infrared sensor and a visible light sensor by the present invention provides a system that can significantly reduce the occurrence of false triggering, as will be described in greater detail below.

Figure 3:
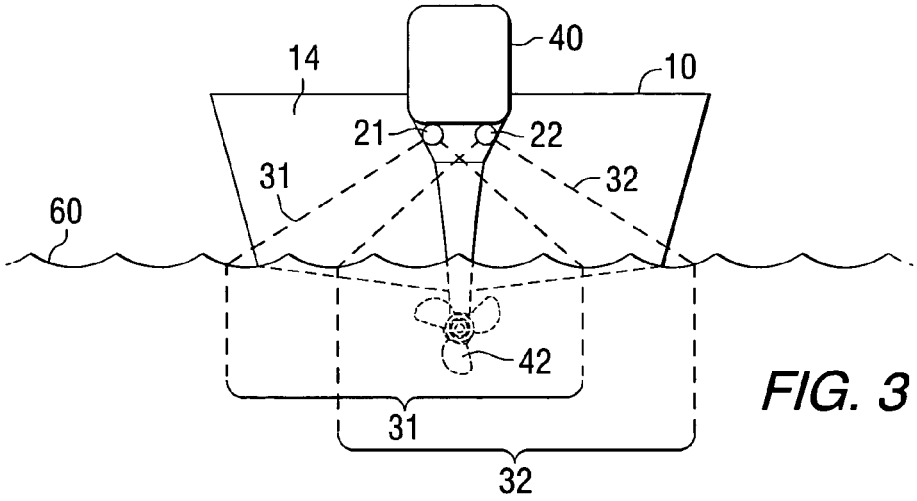
FIG. 3 is a rear view of an outboard motor with two sensors attached to its rearward surface.

FIG. 3 is a rear view of a marine vessel 10 with an outboard motor 40 which serves as the marine propulsion system 12 of the marine vessel 10. The outboard motor 40 is supported at the transom 14 and has a propeller 42 supported for rotation about a propeller shaft in a manner that is well known to those skilled in the art. The first and second electromagnetic radiation sensors, 21 and 22, are attached to the rear portion of the outboard motor 40 and directed so that they define first and second target areas, 31 and 32. The first and second target areas, 31 and 32, are illustrated in FIG. 3 to show both their respective locations and relative sizes.

Figure 4:
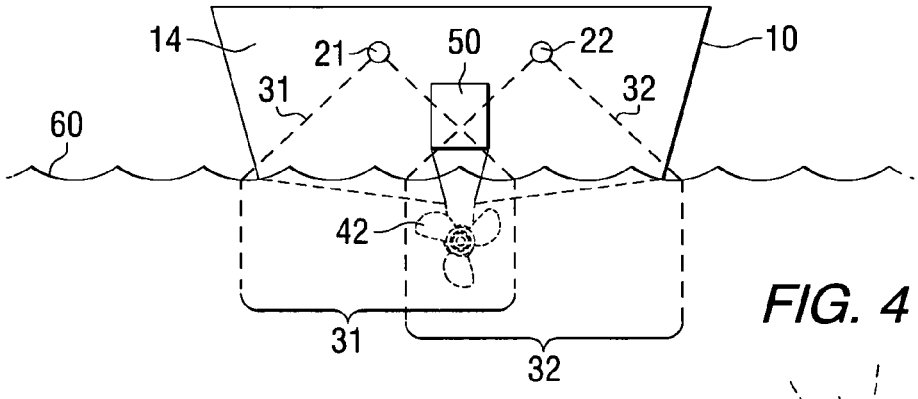
FIG. 4 is a rear view of a marine vessel with electromagnetic radiation sensors attached to its transom.
Figure 5:
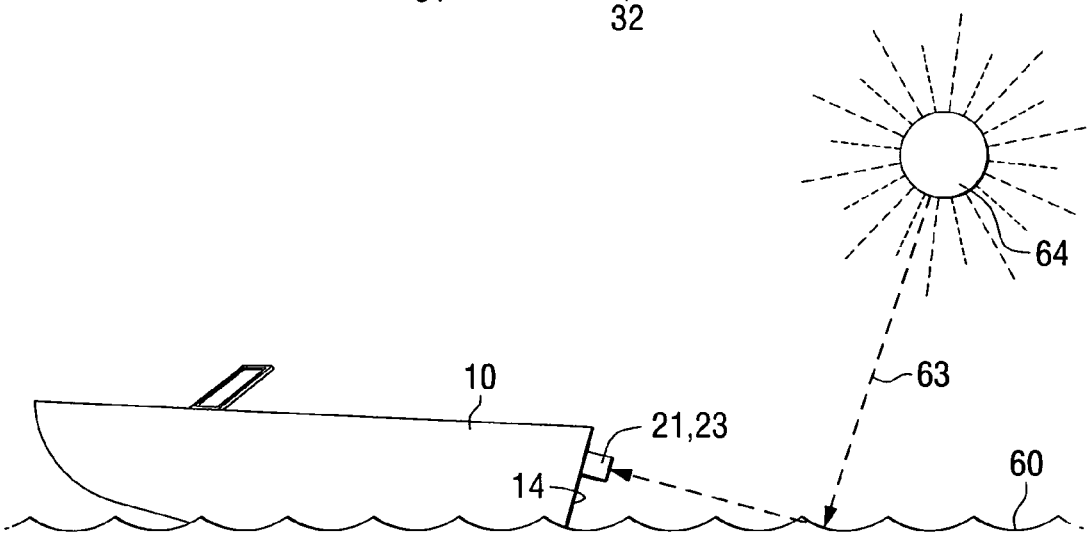
FIG. 5 is a schematic representation showing how sunlight can reflect from the surface of the a body of water and be detected by sensors mounted at the rear portion of a marine vessel.

FIG. 4 shows a marine vessel 10 with a stern drive marine propulsion device 50 attached to its transom 14. The first and second electromagnetic radiation sensors, 21 and 22, are shown attached directly to the transom 14. However, it should be understood that the specific location of attachment (e.g. the transom 14 or the marine propulsion system itself) is not limiting to the scope of the present invention. Reference numerals 31 and 32 in FIG. 4 show the position and relative size of the first and second target areas. FIGS. 1 and 4 show two views of the first and second target areas, 31 and 32, when the first and second electromagnetic radiation sensors, 21 and 22, are attached directly to the transom 14 of a marine vessel 10. In FIGS. 2, 3, and 4, reference numeral 60 is used to identify the surface of the body of water in which the marine vessel 10 is operating. FIG. 5 is a simplified schematic illustration of a marine vessel 10 on a body of water when electromagnetic radiation 63 from the sun 64 reflects off of the surface 60 of water and is received by an electromagnetic radiation sensor attached to the marine vessel 10. In this example shown in FIG. 5, a combined infrared and visible light sensor is contained in a common housing. Although the sensing elements are separate and are sensitive to different ranges of wavelengths, the first and third electromagnetic radiation sensors, 21 and 23, are positioned at the same location. Alternatively, the two sensors can be positioned as shown in FIG. 2 and described above.

Electromagnetic radiation 63 from the sun 64 contains many different wavelengths of radiation. Infrared radiation is what is normally described as heat. It is not visible by human beings and is generally in a range of wavelengths between 1 micrometer and 1 millimeter. Sunlight also contains the visible spectrum of electromagnetic radiation that can be seen by human beings. It is the only electromagnetic radiation that is detectable by the human eye. The range of visible wavelength is approximately from 400 nanometers to 700 nanometers. Sunlight also contains ultraviolet light. If sunlight 63 reflects off of the surface 60 of a body of water and is received by the sensor, the infrared component of the sunlight can cause the sensor 21 to react to the infrared radiation and provide a signal indicating its presence. However, since the infrared radiation did not emanate from a human being or marine mammal, this is considered a false trigger of the sensor.

Since sunlight 63 contains both infrared electromagnetic radiation and visible electromagnetic radiation, the present invention takes advantage of the presence of visible light in the sunlight to detect whether or not the presence of infrared radiation was caused by reflected sunlight and not by the presence of a human being or other mammal. If visible light is also present and detectable by the sensor 23, the present invention concludes that the infrared signal was caused by reflected sunlight and not by the presence of a human being or other mammal. When this occurs, the presence of visible light is used as an indication that the system should not react to the presence of detected infrared radiation. It therefore delays by a preselected period of time, such as approximately 0.5 seconds, and allows the reflected sunlight from the surface 60 to diminish as the wave action changes the direction of reflected sunlight.

It should be understood that various different types of electromagnetic radiation sensors can be used in conjunction with the present invention. In order to sense electromagnetic radiation in the infrared portion of the spectrum, a pyroelectric passive infrared sensor is used in a preferred embodiment of the present invention. A sensor of this type is identified by Model No. RE431B and is available from Nippon Ceramic Company in commercial quantities. It uses a Fresnel lens, which is identified as Model No. NCL-3B from the Nippon Ceramic Company, and is available in commercial quantities. The Fresnel lens creates four zones that act as portions of an overall target area. For example, at a distance of approximately five meters from the lens, the four zones are each approximately 0.86 meters wide with spaces of approximately 0.86 meters between each of the monitored sections. As a source of infrared radiation passes through one or more of the partial zones, the signals received by the infrared sensor changes in magnitude and direction. This allows a sensing system connected to the infrared sensor to determine whether or not a source of infrared radiation is present within the overall target area. A visible light sensor, identified as Model No. N5AC-305075KO by Nippon Ceramic Company, is available in commercial quantities. This visible light sensor responds to the presence of a source of visible light within the target area. By using an infrared sensor in combination with a visible light sensor, the present invention is able to distinguish reflected sunlight from electromagnetic radiation that emanates from a human being or another mammal. It should be understood that other sources of infrared and visible light sensors can be used to obtain appropriate sensors for these purposes in conjunction with the preferred embodiment of the present invention. It should also be understood that the specific types of infrared and visible light sensors described above are not limiting to the scope of the present invention.

Figure 6:
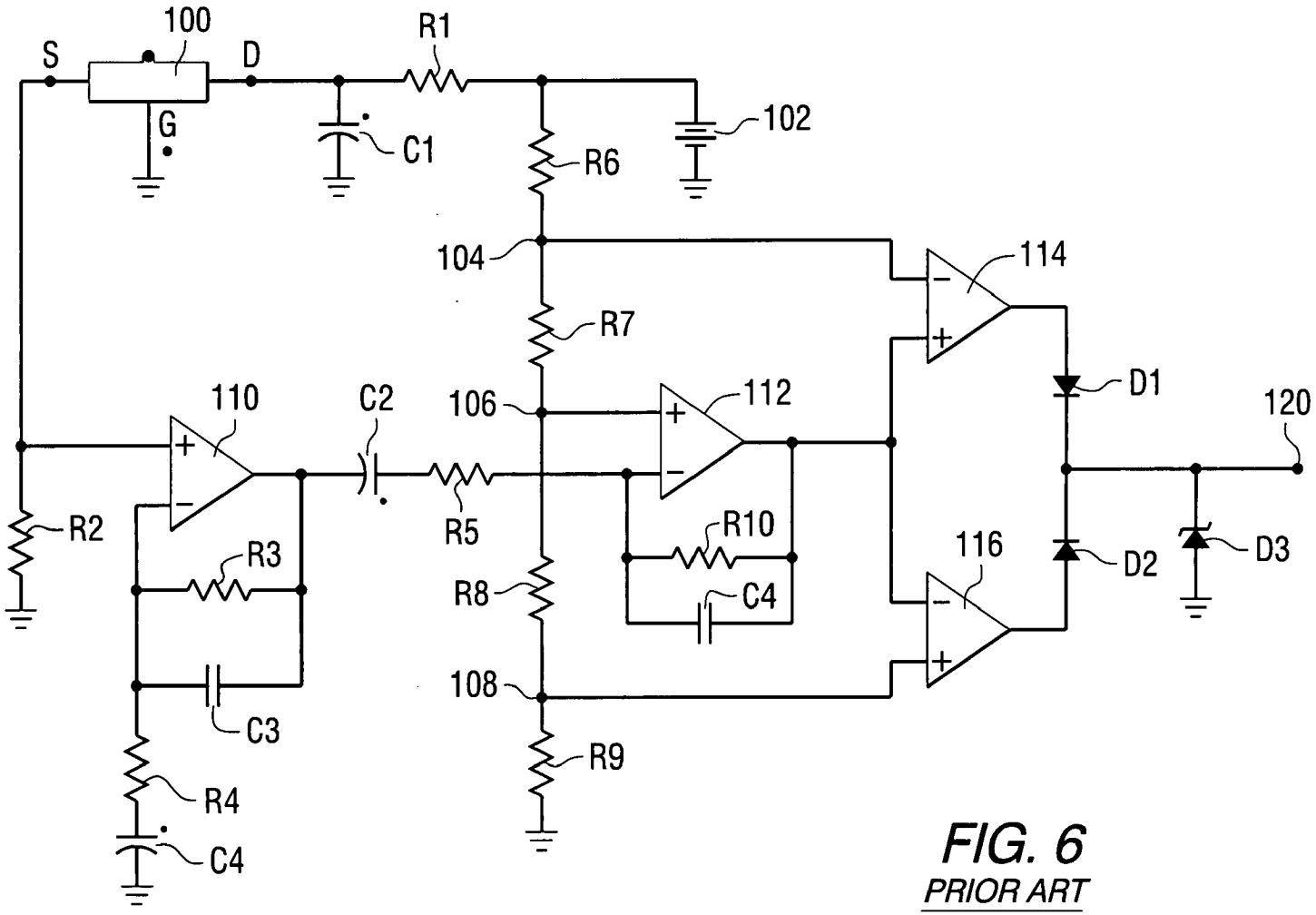
FIG. 6 PRIOR ART
FIG. 6 is a known circuit that can be used to implement an infrared sensor.

In the description of the circuit shown in FIG. 6, the magnitudes of the various discreet components will be identified in parentheses with respect to the reference numeral identification in the following description. The circuits shown in FIG. 6 is a recommended way to use the infrared sensor 100 described above and is known to those skilled in the art. The drain D of the sensor 100 is connected to capacitor C1 (10 μF) and resistor R1 (10 kΩ) as shown. A 9-volt power source 102 is connected to the drain through resistor R1. A voltage divider comprises resistors R6 (8.2 kΩ), R7 (1 kΩ), resistor R8 (1 kΩ), and resistor R9 (8.2 kΩ). This voltage divider provides a 5 volt signal at point 104, a 4.5 volt signal at point 106, and a 4 volt signal at point 108.

With continued reference to FIG. 6, the sources of the infrared detector 100 is connected to ground through resistor R2 (47 kΩ). Operational amplifier 110 is connected in association with resistor R3 (1 MΩ) and capacitor C3 (0.1 μF), resistor R4 (10 kΩ), and capacitor C4 (10 μF). Capacitor C2 (10 μF) and resistor R5 (100 kΩ) are connected to the output of operational amplifier 110. Operational amplifier 112 is associated with resistor R10 (1 MΩ) and capacitor C4 (0.1 μF). Comparators 114 and 116 are connected as shown in association with two opposing diodes, D1 and D2 and a Zenor diode D3 (5.1 v/1N5231). At circuit point 120, a signal is provided that can be connected as an input to a processor, such as a processing circuit or a microprocessor.

In the description of the present invention, the reference to an infrared sensor can include the accompanying circuit shown in FIG. 6 that amplifies the signal from the infrared sensor 100 and compares it so that a change in magnitude can be detected and provided as an output at circuit point 120.

Figure 7:
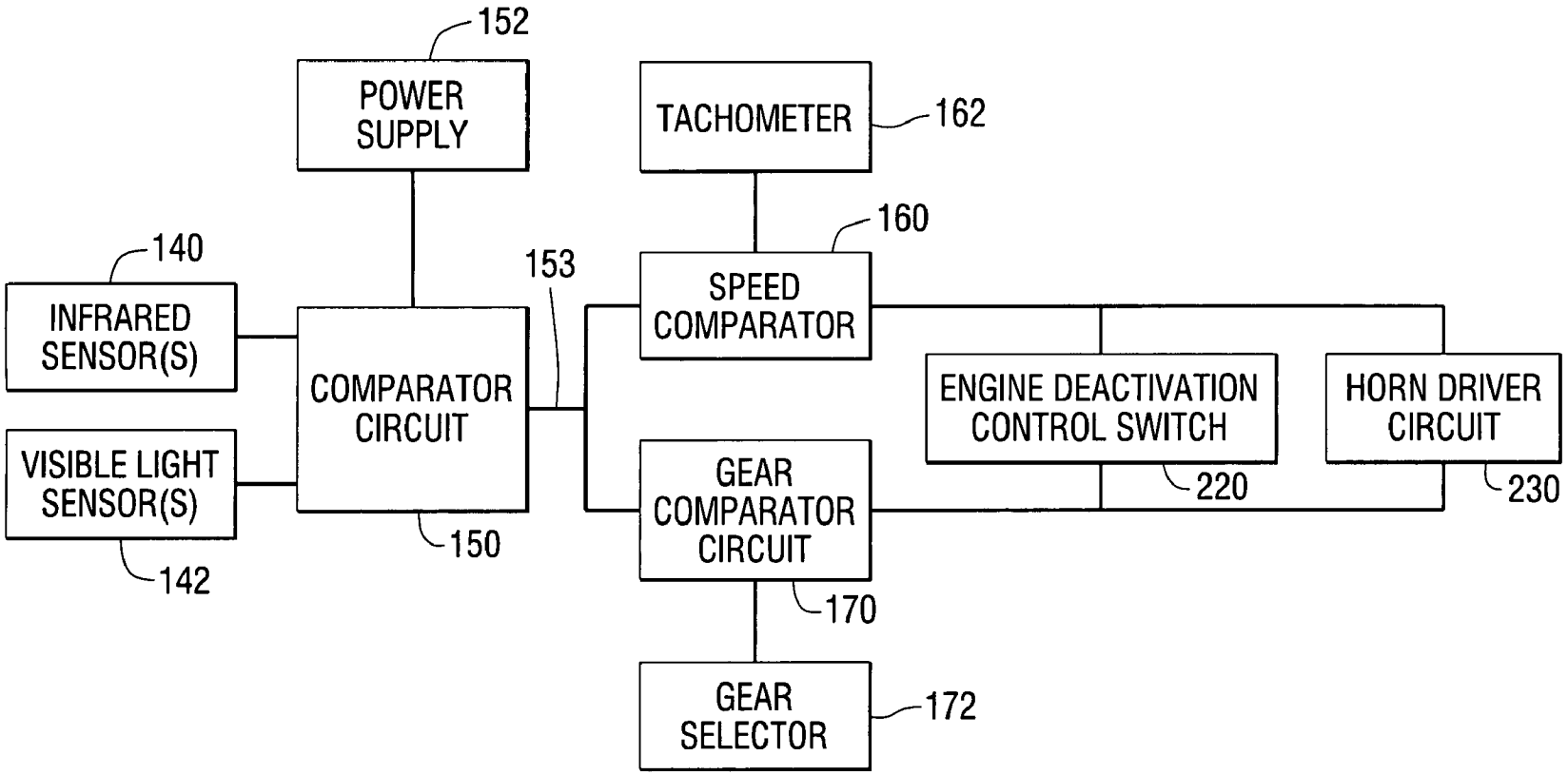
FIG. 7 is a highly schematic representation of a circuit that can be used to receive signals from electromagnetic radiation sensors and take appropriate action in response to those signals.
Figure 8:
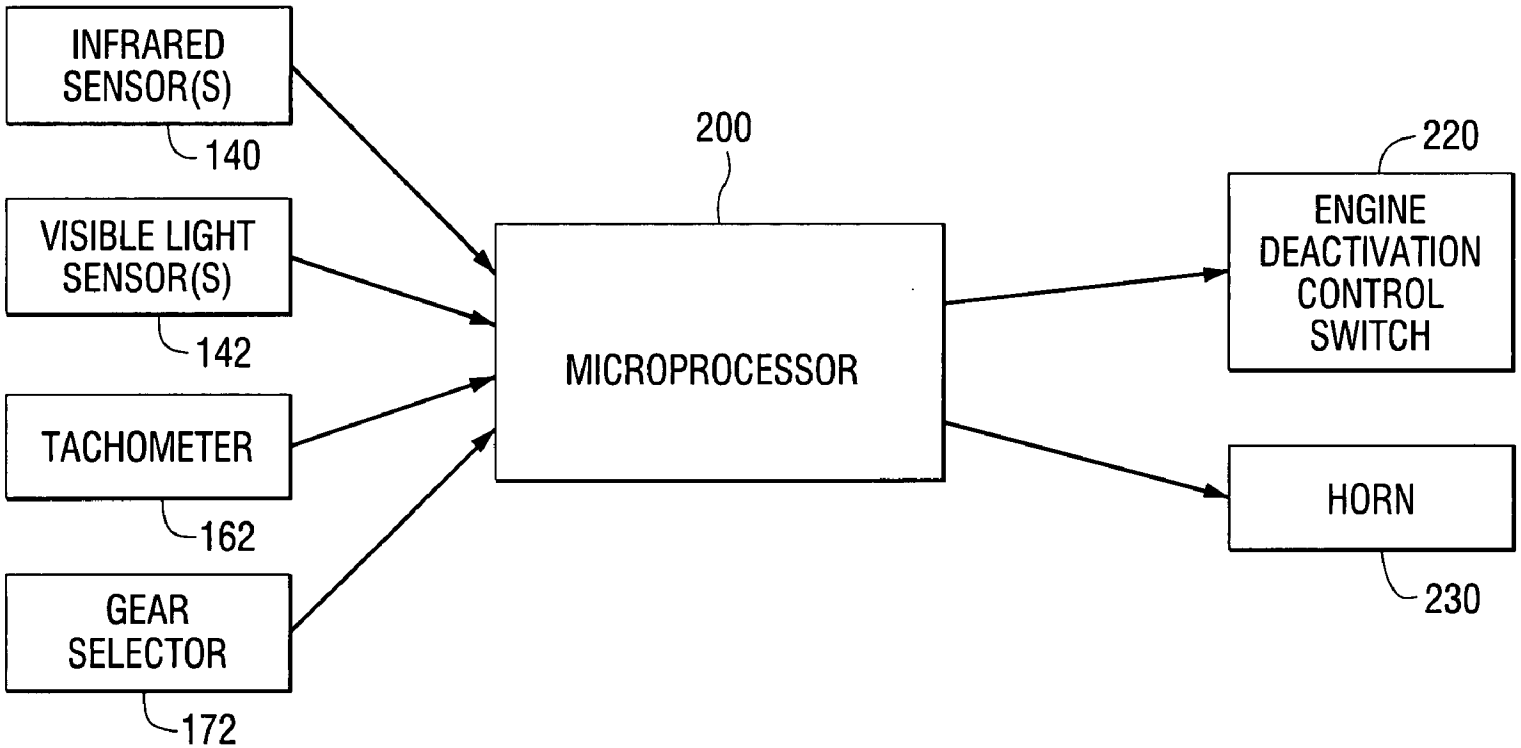
FIG. 8 is a schematic representation of a microprocessor connected to various inputs and outputs.
Figure 9:
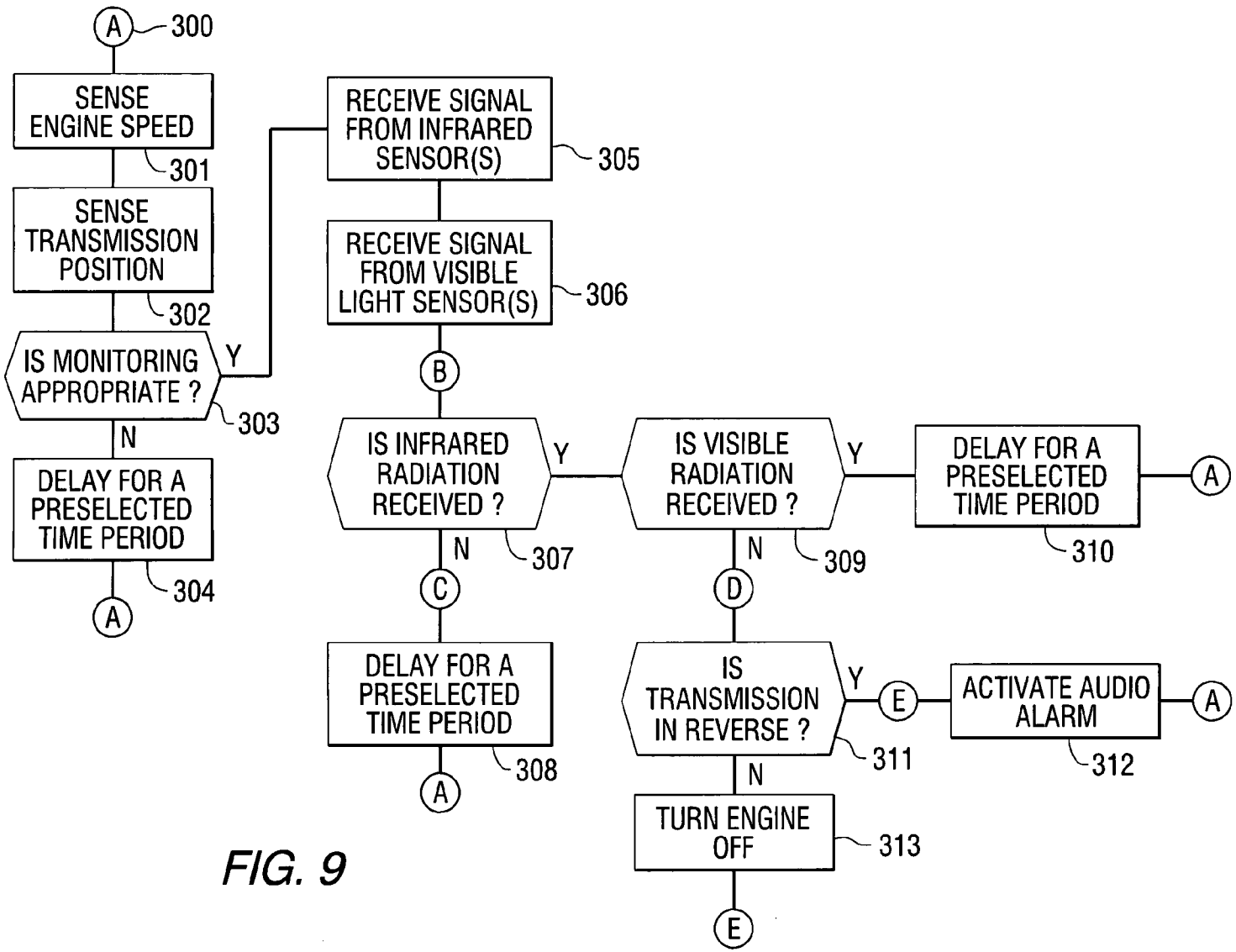
FIG. 9 is a flow chart of a program that can be used in conjunction with the present invention.

It should be understood that the potential configurations and methods of application of the present invention described below in conjunction with FIGS. 7, 8, and 9 and intended to show hypothetical possibilities and are not intended as being either limiting to the present invention or to identify a system or method that is considered superior to others. Instead, the discussion below in conjunction with FIGS. 7, 8, and 9 is intended to illustrate the fact that many appropriate systems can be used in conjunction with the present invention in various different intended applications. These alternative systems and methods should be carefully selected to maximize the utility of the present invention in view of the type of marine vessel with which it is used and the particular facts and circumstances inherent in the intended use of the marine vessel.

FIG. 7 shows a highly simplified schematic representation of a circuit that can be used to receive signals from both the infrared sensors and visible light sensors, process those signals, and take appropriate action to deactivate the engine, activate a horn, or both. In FIG. 7, signals from the infrared sensors and visible light sensors are provided to a comparator circuit 150. The infrared and visible light sensors, 140 and 142, shown in FIG. 7 can comprise associated circuits such as the circuits shown in FIG. 6. The comparator circuit 150 receives the infrared signals and visible light signals and compares them to preselected thresholds to determine whether or not changes have been detected in the magnitudes of those signals. A power supply 152 is connected to the comparator circuit. It should be understood that the logic performed by the comparator circuit 150 can vary in different embodiments of the present invention. However, in a typical application of a preferred embodiment of the present invention, the infrared sensor signals would be compared to threshold magnitudes to determine if a change has occurred in the magnitude of the received signal. If a change has occurred, this is indicative of the presence of an infrared radiation source within the associated target area. In certain situations, this could mean that a human being or marine mammal has moved into the target area being monitored. The comparator circuit 150 would also typically interrogate the signals received from the visible light sensors 142. This would indicate the presence of reflected sunlight and could lead to the conclusion that the detected infrared signals were also caused by the reflected sunlight. In those circumstances, the changes detected in the infrared signals would be momentarily ignored because of the assumption that they were caused by reflected sunlight off of the surface 60 of the body of water in which the marine vessel 10 is being operated. If the infrared signals are not accompanied by visible light signals, the comparator circuit provides an appropriate signal on line 153. This allows a speed comparator and a gear comparator circuit to be used to determine whether or not it is appropriate to react to the signal received on line 153. The speed comparator 160 receives a signal from a tachometer 162 that is representative of the speed of the engine. Although the speed comparator can be configured to perform various operations, a typical comparison would be one between the actual engine speed and a threshold value, such as one that would indicate the relative applicability of a system incorporating the present invention. This comparison may determine whether or not the marine vessel 10 is operating at a speed that is above idle speed. The purpose of this comparison is to determine whether the marine vessel 10 is possibly moving forward at an appreciable rate so that it is unlikely that a human being or other mammal will approach the propeller 42 of the marine vessel from a rearward direction. In other words, if the marine vessel 10 is operating at an engine speed sufficient to propel the marine vessel in a forward direction, it may be unlikely that a human being or other mammal will approach the propeller from a rearward direction. On the other hand, it may be beneficial to ignore engine speed in all cases.

It may also be beneficial to interrogate the condition of the transmission. A gear comparator circuit 170 receives an input from a gear selector 172 which indicates whether or not the transmission is in forward, neutral, or reverse gear. Naturally, the marine vessel 10 cannot be assumed to be moving forward at a significant speed if the transmission is in neutral gear position. If the transmission is in forward gear position and the engine speed is above a preselected threshold, forward motion of the marine vessel may be assumed, depending on the specific algorithm used in the implementation of the present invention. If the transmission is in a reverse gear position, regardless of the engine speed, the circuit can take appropriate action to either activate a horn, deactivate the engine, or both. The specific response to the signals provided by the present invention will depend on the particular control algorithm that is implemented. As an example, any infrared signal indicating the presence of a human being or mammal in the respective monitored areas when the transmission is in reverse gear position may warrant an immediate deactivation of the engine accompanied by an activation of a horn to notify the operator of the marine vessel of this condition. These specific applications and selections of algorithmic control can vary within the scope of the present invention.

FIG. 8 is a simplified schematic representation of the application of the present invention with a processor that comprises a microprocessor 200. The infrared sensors 140 and the visible light sensors 142 are connected as inputs to the microprocessor 200. The tachometer 162 and the gear selector 172 are also connected as inputs to the microprocessor 200. These four inputs are received and examined by the microprocessor 200 according to the algorithm which is programmed into the processor. The visible light signals received from the visible light sensors 142 will be used to determine whether or not signals received by the infrared sensors 140 represent human beings or mammals in the respective target areas or, alternatively, are caused by reflected sunlight. The engine speed and gear position would be considered by the microprocessor 200 in a way that is generally similar to that described above in conjunction with FIG. 7.

With reference to FIGS. 7 and 8, an engine deactivation control switch 220 and a horn driver circuit 230 are connected to outputs of either the control circuitry in FIG. 7 or the microprocessor in FIG. 8. The deactivation of the engine by the engine deactivation control switch 220 and the activation of the horn by the associated horn driver circuit 230 can be done individually or in combination with each other, depending on the desired reaction of the system in response to the detection of a human being or mammal within the respective target areas of the infrared sensors.

FIG. 9 is a flowchart that schematically represents the steps performed by a program in the microprocessor 200 described above in conjunction with FIG. 8. Beginning at step A, which is identified by reference numeral 300, the program senses the engine speed at functional block 301 by receiving a signal from the tachometer 162 and senses the transmission position at functional block 302 by receiving a signal from the gear selector 172. Depending on the engine speed and gear selection, the program determines if monitoring is appropriate at functional block 303. If the tachometer and gear selector, 162 and 172, indicate that monitoring is not appropriate, the program shown in FIG. 9 delays for a preselected period of time and then returns to the starting point 300. As described above, monitoring may be determined to be inappropriate, for example, if the engine speed is relatively high and the transmission is in forward gear position, indicating that the marine vessel is operating at planing speeds which would preclude the likelihood that a human being or other mammal would approach the propeller from a direction behind the transom. Functional block 304 represents the time delay which can be approximately 0.5 to 1 second. If monitoring is determined to be appropriate at functional block 303, the program receives the signal from the infrared sensors 140 at functional block 305 and receives the signals from the visible light sensors 142 at functional block 306. At this point, all information from the light sensors is available to the microprocessor. At functional block 307, the program determines whether or not a change has been detected in the infrared radiation signals. If no change is detected, a preselected time period is executed at functional block 308 and the program returns to the beginning. If, however, a change has been determined in the magnitude of infrared radiation, functional block 309 determines whether or not visible radiation has also been detected. If visible radiation has also been detected, this indicates that the signal detected by functional block 307 was caused by reflected sunlight which, as described above, provides both infrared and visible radiation. In this case, a time delay is executed at functional block 310 and the program returns to the beginning. If, however, infrared radiation was detected but visible radiation was not, the program determines if the transmission is in reverse gear at functional block 311.

As described above, various different algorithms can be used in conjunction with the present invention. It should be clearly understood that any specific response to the sensing of infrared radiation is not limiting to the present invention and the described method is not proposed as being superior to alternative methods of applying the present invention. The timing and order of a horn alarm and/or an immediate deactivation of the engine is not limiting to the present invention. Those alternatives are simply different ways in which the present invention can be applied.

In this particular application of the present invention, the program would next activate an audio alarm at functional block 312. The alarm can be a horn or siren. If the transmission is not in reverse gear, the program can deactivate the engine at functional block 313 and then proceed to functional block 312 to activate the alarm. It should be clearly understood that the portion of the algorithm represented by functional blocks 311, 312, and 313 is merely one possible combination of actions and it is not offered as a preferred or best way. Many different combinations of actions may be preferred to the ones shown in FIG. 9. The particular response of the program when infrared radiation is detected by the present invention can take many forms and is not limiting to the scope of the present invention. Instead, the present invention relates to the detection mechanism and not the response to that detection.

Throughout the description of the present invention, it has been described in terms of an application in conjunction with a particular type of marine propulsion system. However, it should be understood that it can be used in conjunction with other types of marine propulsion systems. Therefore, it should be clearly understood that the present invention can be applied to marine propulsion systems that use any kind of propulsor.

Throughout the description of the present invention, the term "marine vessel" is intended to mean either the hull structure of a boat, the hull combined with a marine propulsion system, or a marine propulsion system itself. Most applications of the present invention can attach sensors to either the transom of the marine vessel or the marine propulsion system (e.g. the outboard motor or stern drive) which is used in conjunction with the marine vessel. In addition, although the present invention has been described above in conjunction with an application that is proximate the stern of the marine vessel, alternative applications could mount the sensors elsewhere on the vessel.

Although the present invention has been described in particular detail and illustrated to show several embodiments, it should be understood that alternative embodiments are also within its scope.

I claim:

1. A detection system for a marine vessel, comprising:

a first electromagnetic radiation sensor which is sensitive to a first preselected range of wavelengths, said first electromagnetic radiation sensor being attachable to said marine vessel and directed toward a first target area to receive electromagnetic radiation from within said first target area, said first electromagnetic radiation sensor being configured to provide a first signal which is representative of electromagnetic radiation within said first preselected range of wavelengths emanating from within said first target area;

a second electromagnetic radiation sensor which is sensitive to a second preselected range of wavelengths, said second electromagnetic radiation sensor being attachable to said marine vessel and directed toward a second target area to receive electromagnetic radiation from within said second target area, said second electromagnetic radiation sensor being configured to provide a second signal which is representative of electromagnetic radiation within said second preselected range of wavelengths emanating from within said second target area; and a processor connected in signal communication with said first and second electromagnetic radiation sensors and configured to receive said first and second signals, said processor being configured to respond to a preselected change in said first or second signals with a change in the operation of said marine vessel;

wherein:

said first electromagnetic radiation sensor is an infrared sensor sensing heat, including heat emanating from a warm blooded animal, including a human, on said body of water and including heat of reflected sunlight reflected from said body of water;

said second electromagnetic radiation sensor is a visible light sensor sensing visible light in said reflected sunlight and preventing said change in operation of said marine vessel to minimize false triggering otherwise due to heat of reflected sunlight sensed by said infrared sensor.

2. The detection system of claim 1, wherein:

said first and second electromagnetic radiation sensors are attachable to a transom of said marine vessel.

3. The detection system of claim 1, further comprising:

a marine propulsion device attached to a transom of said marine vessel, said first and second electromagnetic radiation sensors being attached to said marine propulsion device.

4. The detection system of claim 1, further comprising:

a marine propulsion device attached to a transom of said marine vessel.

5. The detection system of claim 1, wherein:

said first and second target areas at least partially overlap each other.

6. The detection system of claim 1, further comprising:

a third electromagnetic radiation sensor which is sensitive to said first preselected range of wavelengths, said third electromagnetic radiation sensor being attachable to said marine vessel and directed toward a third target area to receive electromagnetic radiation from within said third target area, said third electromagnetic radiation sensor being configured to provide a third signal which is representative of electromagnetic radiation within said first preselected range of wavelengths emanating from within said third target area;

a fourth electromagnetic radiation sensor which is sensitive to said second preselected range of wavelengths, said fourth electromagnetic radiation sensor being attachable to said marine vessel and directed toward a fourth target area to receive electromagnetic radiation from within said fourth target area, said fourth electromagnetic radiation sensor being configured to provide a fourth signal which is representative of electromagnetic radiation within said second preselected range of wavelengths emanating from within said fourth target area; and said processor being connected in signal communication with said first, second, third and fourth electromagnetic radiation sensors and configured to receive said first, second, third and fourth signals, said processor being configured to respond to a preselected change in said first or third signals with a change in the operation of said marine vessel.

7. The detection system of claim 6, wherein:

said processor is configured to refrain from changing said operation of said marine vessel if said second or fourth signals indicate a presence of visible light within said third or fourth target areas, respectively.

8. The detection system of claim 1, wherein:

said processor is a microprocessor which is programmed to respond to said first and second signals.

9. The detection system of claim 1, wherein:

said processor is an electronic circuit.

10. A detection system for a marine vessel, comprising:

a first electromagnetic radiation sensor which is sensitive to a first preselected range of wavelengths, said first electromagnetic radiation sensor being attachable to said marine vessel and directed toward a first target area to receive electromagnetic radiation from within said first target area, said first electromagnetic radiation sensor being configured to provide a first signal which is representative of electromagnetic radiation within said first preselected range of wavelengths emanating from within said first target area;

a second electromagnetic radiation sensor which is sensitive to a second preselected range of wavelengths, said second electromagnetic radiation sensor being attachable to said marine vessel and directed toward a second target area to receive electromagnetic radiation from within said second target area, said second electromagnetic radiation sensor being configured to provide a second signal which is representative of electromagnetic radiation within said second preselected range of wavelengths emanating from within said second target area;

a third electromagnetic radiation sensor which is sensitive to said first preselected range of wavelengths, said third electromagnetic radiation sensor being attachable to said marine vessel and directed toward a third target area to receive electromagnetic radiation from within said third target area, said third electromagnetic radiation sensor being configured to provide a third signal which is representative of electromagnetic radiation within said first preselected range of wavelengths emanating from within said third target area;

a fourth electromagnetic radiation sensor which is sensitive to said second preselected range of wavelengths, said fourth electromagnetic radiation sensor being attachable to said marine vessel and directed toward a fourth target area to receive electromagnetic radiation from within said fourth target area, said fourth electromagnetic radiation sensor being configured to provide a fourth signal which is representative of electromagnetic radiation within said second preselected range of wavelengths emanating from within said fourth target area; and a processor connected in signal communication with said first, second, third and fourth electromagnetic radiation sensors and configured to receive said first, second, third and fourth signals, said processor being configured to respond to a preselected change in said first or third signals with a change in the operation of said marine vessel;

wherein:

said first electromagnetic radiation sensor is an infrared sensor sensing heat, including heat emanating from a warm blooded animal, including a human, on said body of water and including heat of reflected sunlight reflected from said body of water;

said second electromagnetic radiation sensor is a visible light sensor sensing visible light in said reflected sunlight and preventing said change in operation of said marine vessel to minimize false triggering otherwise due to heat of reflected sunlight sensed by said infrared sensor.

11. The detection system of claim 10, wherein:

said first and second preselected range of wavelengths each include the infrared portion of the electromagnetic spectrum, said third and fourth preselected ranges of wavelengths each include the visible portion of the electromagnetic spectrum.

12. The detection system of claim 11, wherein:

said first and second electromagnetic radiation sensors are attachable to a transom of said marine vessel.

13. The detection system of claim 11, further comprising:

a marine propulsion device attached to a transom of said marine vessel, said first and second electromagnetic radiation sensors being attachable to said marine propulsion device.

14. The detection system of claim 10, wherein:

said first and second target areas at least partially overlap each other.

15. The detection system of claim 11, wherein:

said processor is configured to refrain from changing said operation of said marine vessel if said second or fourth signals indicate a presence of visible light within said third or fourth target areas, respectively.

16. The detection system of claim 15, wherein:

said processor is a microprocessor which is programmed to respond to said first and second signals.

17. The detection system of claim 16, wherein:

said processor is an electronic circuit.

18. A system for detecting people proximate marine vessel, comprising:

means for providing a first electromagnetic radiation sensor which is sensitive to a first preselected range of wavelengths, said first electromagnetic radiation sensor being attachable to said marine vessel;

means for directing said first electromagnetic radiation sensor toward a first target area to receive electromagnetic radiation from within said first target area;

means for configuring said first electromagnetic radiation sensor to provide a first signal which is representative of electromagnetic radiation within said first preselected range of wavelengths emanating from within said first target area;

means for providing a second electromagnetic radiation sensor which is sensitive to a second preselected range of wavelengths, said second electromagnetic radiation sensor being attachable to said marine vessel;

means for directing said second electromagnetic radiation sensor toward a second target area to receive electromagnetic radiation from within said second target area;

means for configuring said second electromagnetic radiation sensor to provide a second signal which is representative of electromagnetic radiation within said second preselected range of wavelengths emanating from within said second target area;

means for providing a processor which is connected in signal communication with said first and second electromagnetic radiation sensors to receive said first and second signals; and means for responding to a preselected change in the combined status of said first and second signals by changing an operation of said marine vessel;

wherein:

said first electromagnetic radiation sensor is an infrared sensor sensing heat, including heat emanating from a warm blooded animal, including a human, on said body of water and including heat of reflected sunlight reflected from said body of water;

said second electromagnetic radiation sensor is a visible light sensor sensing visible light in said reflected sunlight and preventing said change in operation of said marine vessel to minimize false triggering otherwise due to heat of reflected sunlight sensed by said infrared sensor.

19. The system of claim 18, wherein:

said processor is a microprocessor which is programmed to respond to said preselected change in the combined status of said first and second signals by changing an operation of said marine vessel.

20. The system of claims 18, wherein:

said processor is an electronic circuit which is configured to respond to said preselected change in the combined status of said first and second signals by changing an operation of said marine vessel.

21. The system of claim 18, further comprising:

means for providing a third electromagnetic radiation sensor which is sensitive to a third preselected range of wavelengths, said third electromagnetic radiation sensor being attachable to said marine vessel;

means for directing said third electromagnetic radiation sensor toward a third target area to receive electromagnetic radiation from within said third target area;

means for configuring said third electromagnetic radiation sensor to provide a third signal which is representative of electromagnetic radiation within said third preselected range of wavelengths emanating from within said third target rea;

means for providing a fourth electromagnetic radiation sensor which is sensitive to a fourth preselected range of wavelengths, said fourth electromagnetic radiation sensor being attachable to said marine vessel;

means for directing said fourth electromagnetic radiation sensor toward a fourth target area to receive electromagnetic radiation from within said fourth target area;

means for configuring said fourth electromagnetic radiation sensor to provide a fourth signal which is representative of electromagnetic radiation within said fourth preselected range of wavelengths emanating from within said fourth target area;

means for providing a processor which is connected in signal communication with said first, second, third, and fourth electromagnetic radiation sensors to receive said first, second, third, and fourth signals; and means for responding to a preselected change in the combined status of said first, second, third, and fourth signals by changing an operation of said marine vessel.

22. The system of claim 21, further comprising:

means for attaching said first, second, third, and fourth electromagnetic radiation sensors to said marine vessel.

23. A system for detecting people proximate marine vessel, comprising the steps of:

providing a first electromagnetic radiation sensor which is sensitive to a first preselected range of wavelengths, said first electromagnetic radiation sensor being attachable to said marine vessel;

directing said first electromagnetic radiation sensor toward a first target area to receive electromagnetic radiation from within said first target area;

configuring said first electromagnetic radiation sensor to provide a first signal which is representative of electromagnetic radiation within said first preselected range of wavelengths emanating from within said first target area;

providing a second electromagnetic radiation sensor which is sensitive to a second preselected range of wavelengths; said second electromagnetic radiation sensor being attachable to said marine vessel;

directing said second electromagnetic radiation sensor toward a second target area to receive electromagnetic radiation from within said second target area;

configuring said second electromagnetic radiation sensor to provide a second signal which is representative of electromagnetic radiation within said second preselected range of wavelengths emanating from within said second target area;

providing a processor which is connected in signal communication with said first and second electromagnetic radiation sensors to receive said first and second signals; and responding to a preselected change in the combined status of said first and second signals by changing an operation of said marine vessel;

wherein:

said first electromagnetic radiation sensor is an infrared sensor sensing heat, including heat emanating from a warm blooded animal, including a human, on said body of water and including heat of reflected sunlight reflected from said body of water;

said second electromagnetic radiation sensor is a visible light sensor sensing visible light in said reflected sunlight and preventing said change in operation of said marine vessel to minimize false triggering otherwise due to heat of reflected sunlight sensed by said infrared sensor.

24. The system of claims 23, wherein:

said processor is a microprocessor which is programmed to respond to said preselected change in the combined status of said first and second signals by changing an operation of said marine vessel.

25. The system of claim 23, wherein:

said processor is an electronic circuit which is configured to respond to said preselected change in the combined status of said first and second signals by changing an operation of said marine vessel.

26. The system of claim 23, wherein:

providing a third electromagnetic radiation sensor which is sensitive to a third preselected range of wavelengths, said third electromagnetic radiation sensor being attachable to said marine vessel;

directing said third electromagnetic radiation sensor toward a third target area to receive electromagnetic radiation from within said third target area;

configuring said third electromagnetic radiation sensor to provide a third signal which is representative of electromagnetic radiation within said third preselected range of wavelengths emanating from within said third target area;

providing a fourth electromagnetic radiation sensor which is sensitive to a fourth preselected range of wavelengths, said fourth electromagnetic radiation sensor being attachable to said marine vessel;

directing said fourth electromagnetic radiation sensor toward a fourth target area to receive electromagnetic radiation from within said fourth target area;

configuring said fourth electromagnetic radiation sensor to provide a fourth signal which is representative of electromagnetic radiation within said fourth preselected range of wavelengths emanating from within said fourth target area;

providing a processor which is connected in signal communication with said first, second, third, and fourth electromagnetic radiation sensors to receive said first, second, third, and fourth signals; and responding to a preselected change in the combined status of said first, second, third, and fourth signals by changing an operation of said marine vessel.

27. The system of claim 26, further comprising:

attaching said first, second, third and fourth electromagnetic radiation sensors to said marine vessel.

* * * * *